US010612293B1

(12) United States Patent
Nordgaard et al.

(10) Patent No.: US 10,612,293 B1
(45) Date of Patent: Apr. 7, 2020

(54) STORM OR SECONDARY WINDOW INSTALLATION SYSTEM AND METHOD OF INSTALLATION

(71) Applicant: Larson Manufacturing Company of South Dakota, Inc., Brookings, SD (US)

(72) Inventors: Kelly D. Nordgaard, Gary, SD (US); Andres Abraham, Maple Grove, MN (US)

(73) Assignee: LARSON MANUFACTURING COMPANY OF SOUTH DAKOTA, INC., Brookings, SD (US)

( * ) Notice: Subject to any disclaimer, the term of this patent is extended or adjusted under 35 U.S.C. 154(b) by 0 days.

(21) Appl. No.: 16/031,467

(22) Filed: Jul. 10, 2018

Related U.S. Application Data

(60) Provisional application No. 62/530,919, filed on Jul. 11, 2017.

(51) Int. Cl.
*E06B 3/28* (2006.01)
*E06B 9/00* (2006.01)
*E06B 7/23* (2006.01)

(52) U.S. Cl.
CPC ..... *E06B 3/28* (2013.01); *E06B 9/00* (2013.01); *E06B 7/23* (2013.01); *E06B 2009/005* (2013.01)

(58) Field of Classification Search
CPC ..... E06B 3/28; E06B 9/00; E06B 7/23; E06B 2009/005
See application file for complete search history.

(56) References Cited

U.S. PATENT DOCUMENTS 2,889,900 A * 6/1959 Singleton ..... E06B 3/2605 49/397
D247,047 S * 1/1978 Damiana ..... D25/48.7
4,199,900 A * 4/1980 Johnston ..... E06B 3/28 49/404
4,274,468 A * 6/1981 McPhail ..... E06B 3/28 160/90
4,407,100 A * 10/1983 Huelsekopf ..... E06B 1/30 49/504
4,453,855 A * 6/1984 Richter ..... E06B 3/667 403/295
4,454,691 A * 6/1984 Mitchell ..... E06B 9/04 160/107

(Continued)

*Primary Examiner* — Paola Agudelo
(74) *Attorney, Agent, or Firm* — Kagan Binder, PLLC

(57) ABSTRACT

A secondary window system installable within a primary window frame that includes a top horizontal member, a bottom horizontal member spaced from the top horizontal member, and first and second side members, the secondary window system including a top channel member attachable to and extending along at least a portion of the top horizontal member of the primary window frame, a secondary window frame comprising a header, a sill spaced from the header, first and second side jambs spaced from each other and extending from the header to the sill, and a secondary window opening defined by the secondary window frame, a top channel retainer engageable with the header of the secondary window frame, and at least one hanger engageable with the top channel member and the top channel retainer, wherein the secondary window frame is rotatably moveable relative to the primary window frame about the at least one hanger.

26 Claims, 21 Drawing Sheets

(56) References Cited

U.S. PATENT DOCUMENTS

| | | | | | |
|---|---|---|---|---|---|
| 5,228,238 | A * | 7/1993 | Fenkell | E06B 3/38 | 49/125 |
| 5,347,775 | A * | 9/1994 | Santos | E06B 9/00 | 49/460 |
| 5,390,454 | A * | 2/1995 | Coddens | E06B 3/28 | 160/107 |
| 5,720,137 | A * | 2/1998 | Rodriquez | E06B 3/28 | 160/269 |
| 5,737,874 | A * | 4/1998 | Sipos | E06B 9/02 | 49/63 |
| 5,737,885 | A * | 4/1998 | Stoyke | E06B 3/28 | 52/202 |
| 8,272,178 | B2 | 9/2012 | Pardue et al. | | |
| 2004/0112553 | A1* | 6/2004 | Minnich | E06B 3/28 | 160/378 |
| 2006/0236622 | A1* | 10/2006 | Allen | E06B 3/28 | 52/203 |
| 2011/0047875 | A1* | 3/2011 | Kelley | E06B 3/28 | 49/63 |

* cited by examiner

STORM OR SECONDARY WINDOW INSTALLATION SYSTEM AND METHOD OF INSTALLATION

CROSS-REFERENCE TO RELATED APPLICATIONS

This application claims priority to U.S. Provisional Patent Application No. 62/530,919, filed Jul. 11, 2017, the entire contents of which are incorporated herein by reference in its entirety.

TECHNICAL FIELD

The present invention relates generally to storm windows, and more particularly to secondary or storm window systems that can be used in various window openings.

BACKGROUND

Home and office building constructions commonly include multiple window openings in which primary windows are installed, which may optionally include screens and moveable window panes. In particularly harsh environments or in older constructions, it is common to mount storm windows or other secondary systems such as plastic sheeting on the inside or outside of the primary windows in order to increase the efficiency of the entire window area. For example, it is common to install storm windows adjacent to primary windows to minimize both the leakage of cold air into the interior living space and the escape of warm air into the surrounding environment, as well as to reduce exterior noise entering the interior living space through the windows. However, the installation of many secondary window systems is often cumbersome and may not necessarily provide for a secure attachment of the window systems to the primary window opening structure. There is therefore a desire to provide improved storm window constructions that include easy and secure installation methods, while also allowing for convenient operation, cleaning, and maintenance of both the primary window and the storm window.

SUMMARY

Embodiments of the window systems described herein are directed to a secondary window system installable within a primary window frame that includes a top horizontal member, a bottom horizontal member spaced from the top horizontal member, and first and second side members spaced from each other and extending between the top and bottom horizontal members. The secondary window system comprises a top channel member attachable to and extending along at least a portion of the top horizontal member of the primary window frame, a secondary window frame comprising a header, a sill spaced from the header, first and second side jambs spaced from each other and extending from the header to the sill, and a secondary window frame opening defined by the secondary window frame. The window system further includes a top channel retainer engageable with the header of the secondary window frame and the top channel member and at least one hanger engageable with the top channel member and the top channel retainer, wherein the secondary window frame is rotatable relative to the primary window frame about the at least one hanger.

The secondary window system can further include a first window panel mounted within the secondary window frame opening and a second window panel mounted within the secondary window frame opening and moveable relative to the first window panel, wherein the first window panel may be fixed or moveable within the secondary window frame opening. The first and second window panels, if moveable, may move in either a vertical or a horizontal direction. At least one of the window panels may be a glass panel. In an embodiment, the inner window opening includes a single fixed window panel and in another embodiment the inner window opening includes three or more window panels in which any or all of the panels are moveable and the remaining panels are fixed.

To provide for engagement at the side of the window opposite the hangers (e.g., the bottom of the illustrated window system), the secondary window system may further include at least one bottom stop member engageable with the bottom horizontal member of the primary window frame. The bottom stop members may include a first bottom stop member that is also attachable to the first side member of the primary window frame and a second bottom stop member that is also attachable to the second side member of the primary window frame. The sill of the secondary window frame can be engageable with any bottom stop members when the secondary window system is in a closed position and can be spaced from any bottom stop members when the secondary window system is in an at least partially open position.

The sealing of the secondary window system can be further supplemented by the use of weatherstrips in combination with the primary and secondary window frames. In particular, embodiments of the secondary window systems can include first and second primary weatherstrips positionable between the first and second side jambs of the secondary window frame and the first and second side members of the primary window frame, respectively. The system can further include first and second intermediate weatherstrips positionable between the first and second primary weatherstrips and the first and second side members of the primary window frame, respectively. The system can still further include a sill weatherstrip positionable between the sill of the secondary window frame and the bottom horizontal member of the primary window frame.

Attachment and movement of the various components of embodiments of the secondary window systems can be accomplished using features such as: a hook member of the top channel member being engageable with an extending member of at least one hanger; the top channel member including a top channel support member, wherein the hook member extends from the top channel support member toward the extending member of the at least one hanger; the top channel retainer including a first top channel retainer extension engageable with the top channel support member of the top channel member; the top channel retainer including at least one retaining feature for limiting rotation of the secondary window frame relative to the primary window frame; and the at least one retaining feature including a first extension member engageable with the at least one hanger for limiting rotation of the secondary window frame relative to the primary window frame.

These and various other features and advantages will be apparent from a reading of the following detailed description.

BRIEF DESCRIPTION OF THE DRAWINGS

The present invention will be further explained with reference to the appended Figures, wherein like structure is referred to by like numerals throughout the several views, and wherein:

FIG. 14 is a perspective view of the secondary or storm window of FIG. 13 in a position in which its hangers are attached to the top channel of the window frame and the bottom is rotated partially outward to provide access for locking/unlocking, adjusting the sashes of the primary window, cleaning, or the like;

DETAILED DESCRIPTION

Figure 1:
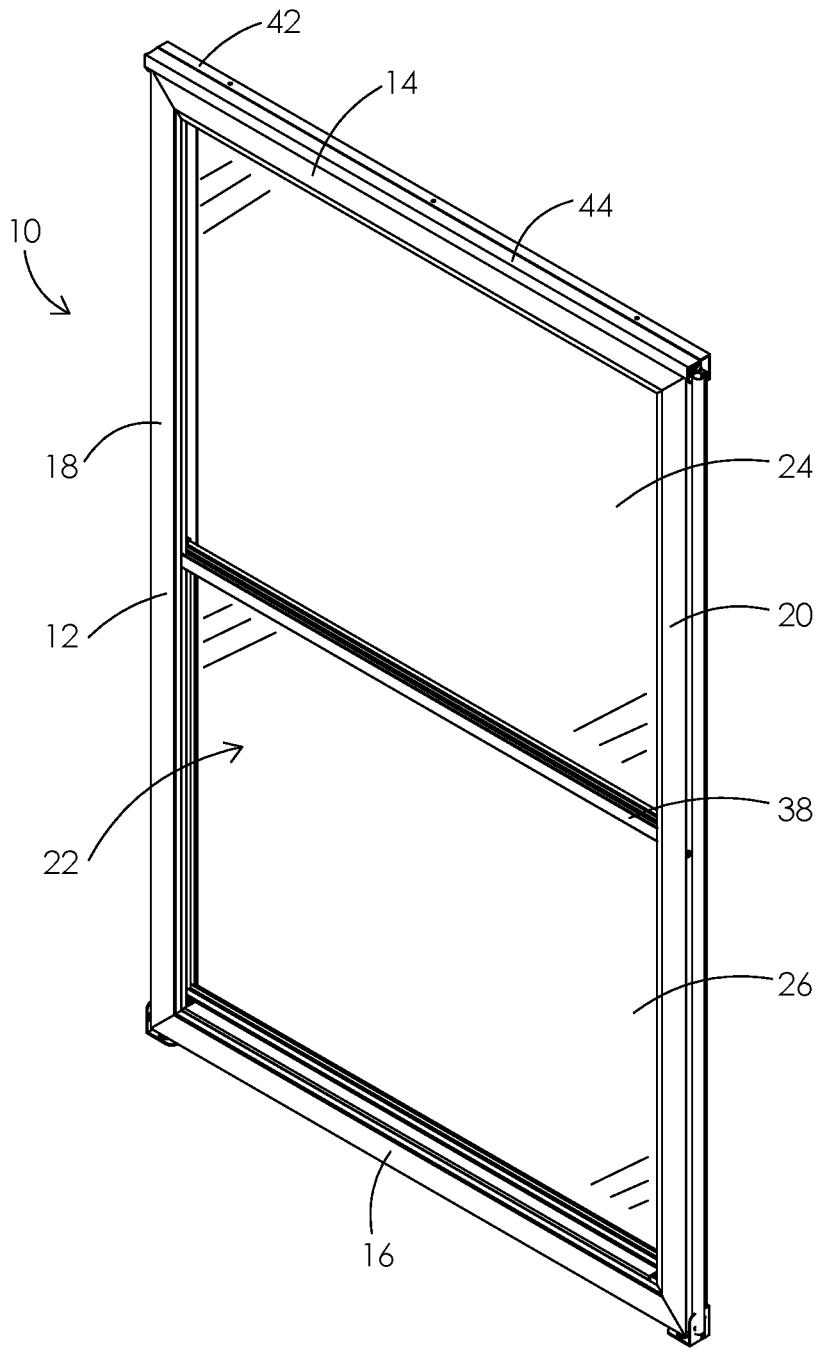
FIG. 1 is an isometric view of a secondary or storm window having upper and lower window panes and a middle mullion.

The present disclosure is directed to secondary or storm window systems that can be attached to the inside and/or outside of a window opening in a building. The secondary window systems are designed to be easily attachable to existing window constructions that have a primary window system already installed, although it is contemplated that buildings can be newly constructed with components that utilize the secondary window systems of the invention (in which case they may be considered to be a primary window system). These secondary window systems are rotatable about a hanger or hinge such that one portion (e.g., the bottom) of the secondary window frame can be moved away from the primary window frame to provide access to the primary window. In this way, the primary window can be adjusted (e.g., by moving a glass panel for ventilation), locked or unlocked, and/or cleaned without completely removing the secondary window system.

Although window system embodiments are described herein with relative terms such as "top" and "bottom", it is understood that these terms are provided for clarity of description but that the same description of features equally applies to embodiments in which the windows are installed in different orientations such as 180 degrees from that shown and described (i.e., features described as being positioned at the "top" of a window system can instead be positioned at the "bottom" of a window system when viewing the system in a typical manner) or at 90 degrees from that shown and described (i.e., features described as being positioned at the "top" or "bottom" of a window system can instead be positioned at the "sides" of a window system).

Embodiments of the secondary window systems include a hinge and retainer system that limits the amount the secondary window can rotate relative to the primary window and also keeps the secondary window securely attached to the window frame. The system further includes bottom corner members that provide for sealing of the secondary window frame relative to the primary window frame and also stop the secondary window frame from contacting the primary window. These corner members can contain weatherstrip material installed from the back surface via any type of design that holds it in place once it is fastened to the opening, for example, or can be attached to the bottom corner members in a different manner.

In accordance with embodiments of the secondary window system, a hinge mechanism can include a top channel with a receptacle, a J-shaped or hook-shaped member extending from the header of the window, and a retainer that covers these components. The secondary window system containing this mechanism fits in place by using a bulb weather strip that compresses against the wall of the opening on the sides and the bottom, and is secured in place with the hinge mechanism herein described. The hinge allows free swinging of the secondary window while keeping it connected to the opening at the top. Once the retainer is securely placed, it serves to limit the travel of the secondary window, but it also ensures that the secondary window stays secured to the primary window frame during this movement and cannot be unintentionally be disengaged from the top channel.

Figure 2:
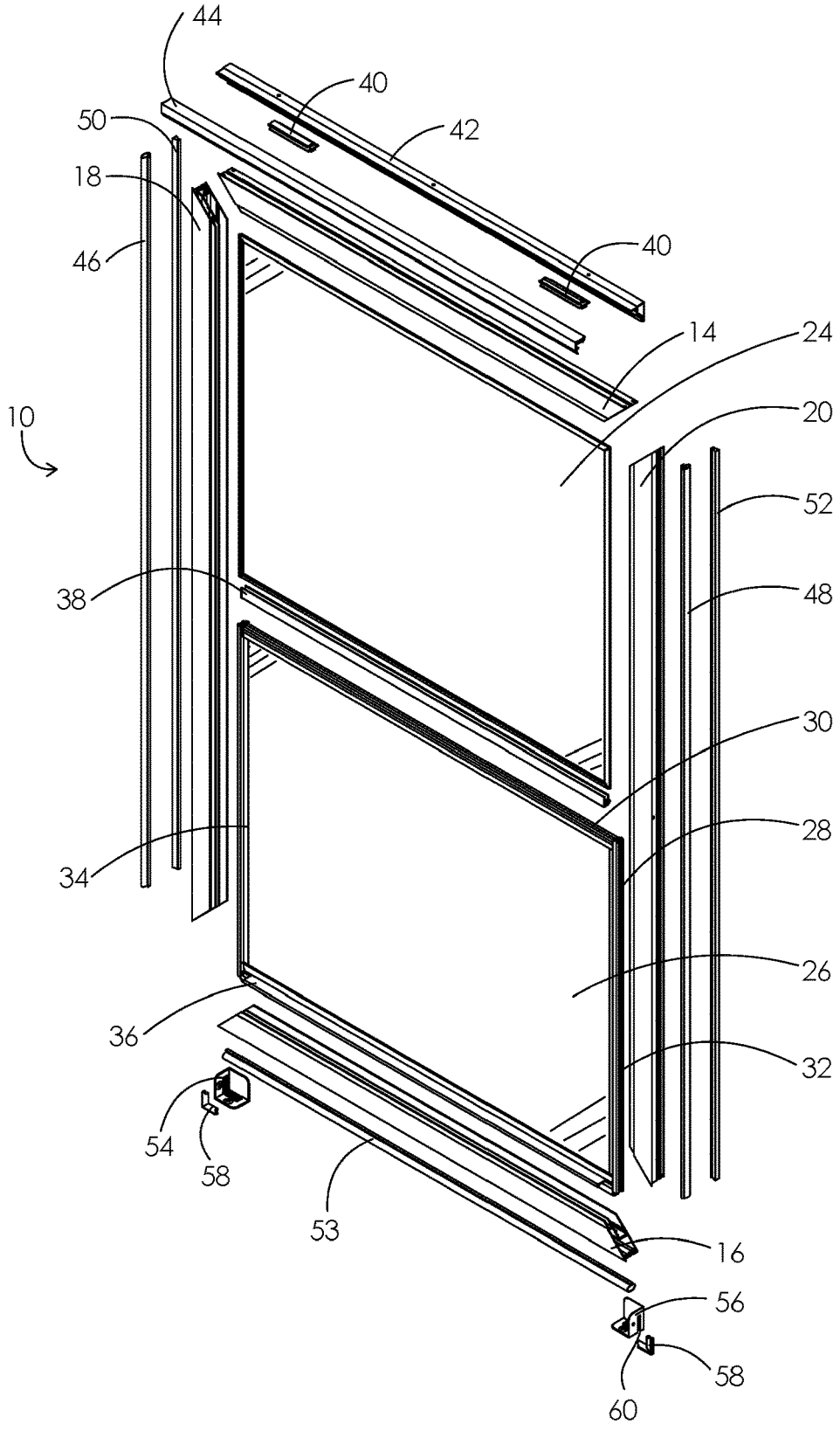
FIG. 2 is an exploded isometric view of an embodiment of a secondary or storm window of the type illustrated in FIG. 1.

Referring now to the Figures, wherein the components are labeled with like numerals throughout the several Figures, and initially to FIGS. 1 and 2, an embodiment of a secondary or storm window system 10 of the invention is illustrated. Secondary window system 10 generally includes a secondary window frame 12 that includes a header 14, a sill 16, and first and second side jambs 18, 20 extending from the header 14 to the sill 16 on opposite sides of the secondary window frame 12. An inner window opening 22 is defined by the secondary window frame 12, and at least one window panel is positioned within the inner window opening 22. In this embodiment, a first window panel 24 is mounted in a fixed manner within the inner window opening 22, and a second window panel 26 is slideably mounted within channels of the first and second side jambs 18, 20, although the window panels 24, 26 can both be fixed, both be moveable, or can be reversed such that the second window panel 26 is fixed and the first window panel 24 is moveable. In any case, when a moveable window panel is provided, it will preferably include its own frame 28 that may include a top rail 30, side stiles 32, 34, and a lift rail 36. The secondary window frame 12 may further include a mullion 38 extending across the inner window opening 22. The window panels 24, 26 may be made of glass, plastic, or other suitable material, and may be transparent, opaque, or translucent. Alternatively, the inner window opening 22 may contain a single fixed window panel, or may contain three or more window panels which any or all of the panels are moveable and any remaining panels are fixed.

In accordance with an embodiment of the secondary window system 10, at least one hanger 40 is secured to the header 14 of the secondary window frame 12, wherein the illustrated embodiment shows two of such hangers 40. It is understood that more or less than two hangers 40 can be provided, as it may be desirable to provide additional hangers 40 for particularly large or heavy window systems and likewise may be desirable to provide less hangers 40 for relatively small or lightweight window systems.

The secondary window system 10 further includes an elongated top channel member 42 that will be secured to a top horizontal member of a primary window frame into which the secondary window frame 12 will be installed. The top channel member 42 can be installed via multiple screws or other fasteners, or with adhesive or another securing method. The window system 10 further includes a top channel retainer 44 that is engageable with the header 14 and, when assembled in the manner described below, includes a portion that will cover the hangers 40 and secure the components of the assembly to each other.

To increase the airtightness of the secondary window systems 10, embodiments can further include one or more weatherstrips on the sides of the secondary window frame 12. In this embodiment, a first interior weatherstrip 46 is positioned adjacent to the first side jamb 18 and a second interior weatherstrip 48 is positioned adjacent to the second side jamb 20. Additional weatherstrips can also be provided, including a first intermediate weatherstrip 50 positioned adjacent to the first side jamb 18 and first interior weatherstrip 46 and a second intermediate weatherstrip 52 positioned adjacent to the second side jamb 20 and the second interior weatherstrip 48. The system may further include a sill weatherstrip 53 positioned adjacent to the sill 16 of the secondary window frame 12. Embodiments of the secondary window system can include more or less than these described and illustrated weatherstrips, as desired.

The secondary window system 10 further includes features for sealing the bottom portion of the window frame 12 against a primary window frame to which it is attached. In particular, the system 10 includes a first bottom corner stop 54 and a second bottom corner stop 56 that are attachable to a bottom horizontal member of a primary window frame. In more particularity, the first bottom corner stop 54 is positionable in a corner of a primary window frame so that it can be secured both to a bottom horizontal member of that frame and also to a one of the side members of the primary window frame (i.e., adjacent to the first side jamb 18 of the window frame 12). Similarly, the second bottom corner stop 56 is positionable in a corner that is opposite the corner in which the first bottom corner stop 54 is installed, and is positionable so that it can be secured both to the same bottom horizontal member of the primary window frame as the corner stop 54 and also to the other of the side members of the primary window frame (i.e., adjacent to the second side jamb 20 of the window frame 12). As shown, each of the bottom corner stops 54, 56 includes a channel 60 through which corner stop weatherstrips 58 can be positioned.

Figure 11:
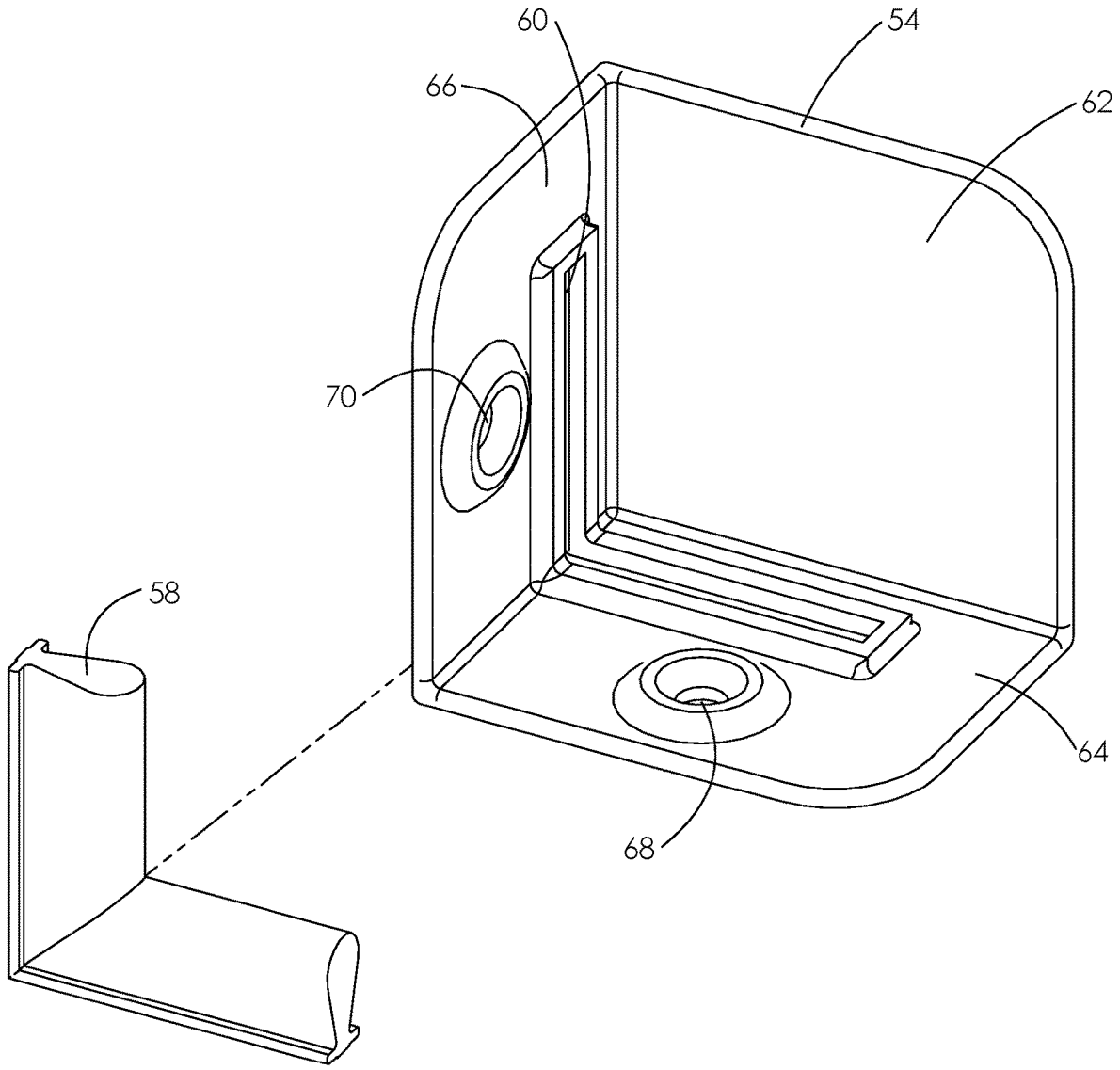
FIG. 11 is an enlarged and exploded isometric view of a bottom corner stop and a corner stop weatherstrip of an embodiment of a secondary or storm window of the type illustrated in FIG. 2, for example.
Figure 12:
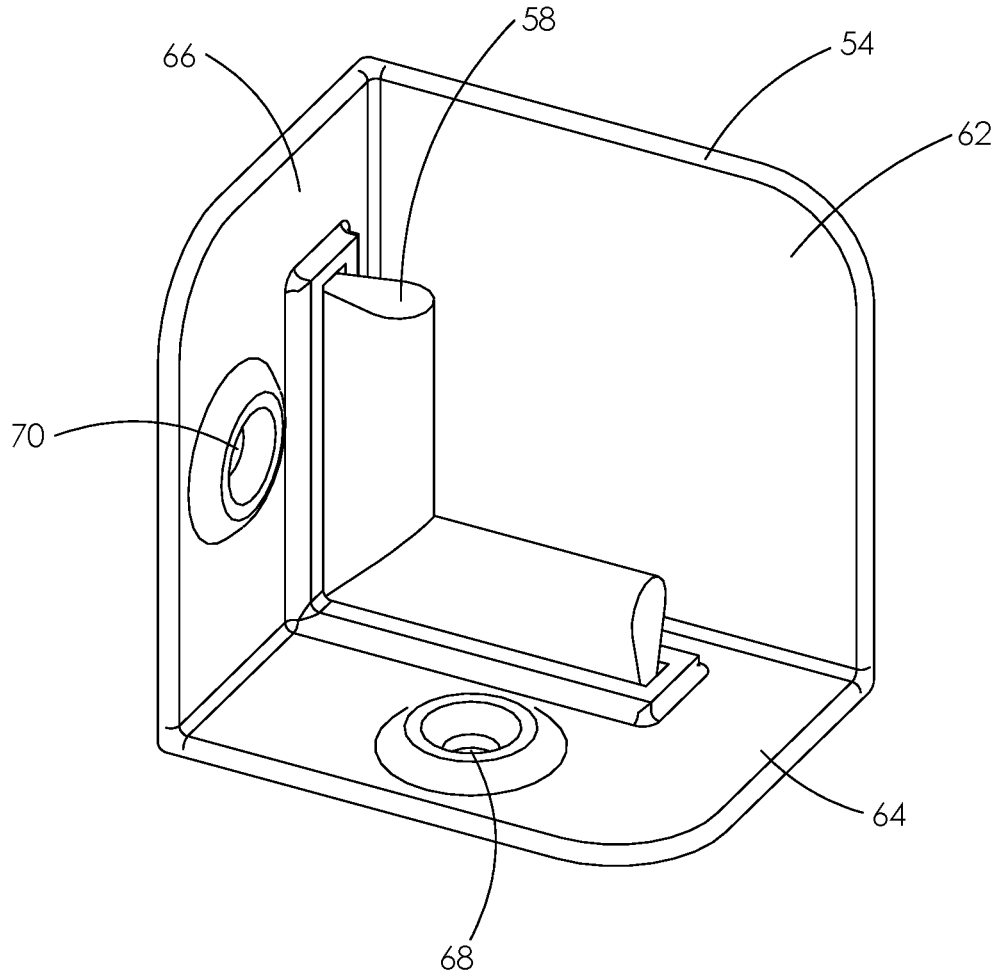
FIG. 12 is an enlarged isometric view of the bottom corner stop and corner stop weatherstrip of FIG. 11 in an assembled configuration.

Referring additionally to FIGS. 11 and 12 for more detail of the bottom corner stops, an enlarged view of an embodiment of bottom corner stop 54 is illustrated, which includes three walls 62, 64, 66 arranged at generally right angles to each other. L-shaped channel or gap 60 is provided along adjacent walls 64, 66 so that an L-shaped corner stop weatherstrip 58 can be engaged within the channel. The wall 64 is also provided with a hole 68 for securing the bottom corner stop 54 to a bottom horizontal member of a primary frame with a fastener, and the wall 66 is provided with a hole 70 for securing the bottom corner stop 54 to a side member of a primary frame with a fastener. The weatherstrips 58 are designed so that the corners where the sill 16 of the secondary window frame 12 meets the first and second side jambs 18, 20 can be received snugly in the bottom corner stops 54, 56.

While bottom corner stop 54 is shown and described in FIG. 11 to be installed in a lower left corner of the primary frame, bottom corner stop 54 may be designed such that a single part may be used universally in both lower left and lower right corners of the primary frame. That is, when rotated 90 degrees counter-clockwise about an axis perpendicular to wall 62, bottom corner stop may also be installed in a lower right corner of the primary frame. In this case, hole 70 in wall 66 would be used to secure bottom corner stop 54 to a bottom horizontal member of the primary frame with a fastener and hole 68 in wall 64 would be used to secure bottom corner stop 54 to a side member of the primary frame with a fastener. Additionally, corner stop weatherstrip 58 could be manufactured in a linear configuration with a 90-degree notch removed from the center portion of weatherstrip 58 and folded to the L-shaped configuration depicted in FIGS. 11 and 12, before or while it is engaged with L-shaped channel or gap 60.

Figure 3:
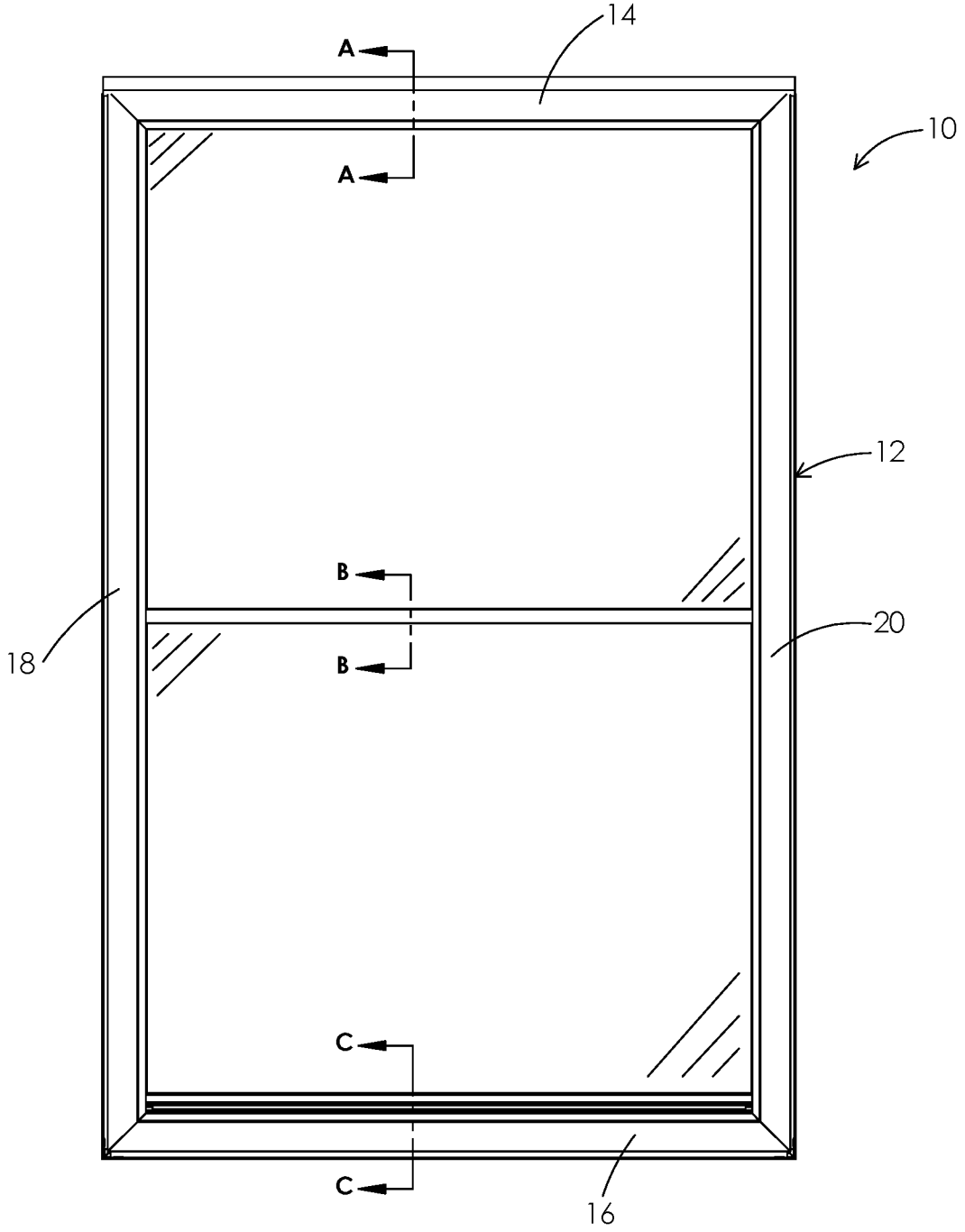
FIG. 3 is a front view of an embodiment of a secondary or storm window and including section lines A-A, B-B and C-C.

FIG. 3 is a front view of an embodiment of the secondary window system 10 of FIGS. 1 and 2. This figure includes section lines A-A, B-B and C-C to represent the cross-sectional views described below for FIGS. 4A-4B, 5, and 6, respectively, as described below.

Figure 4A:
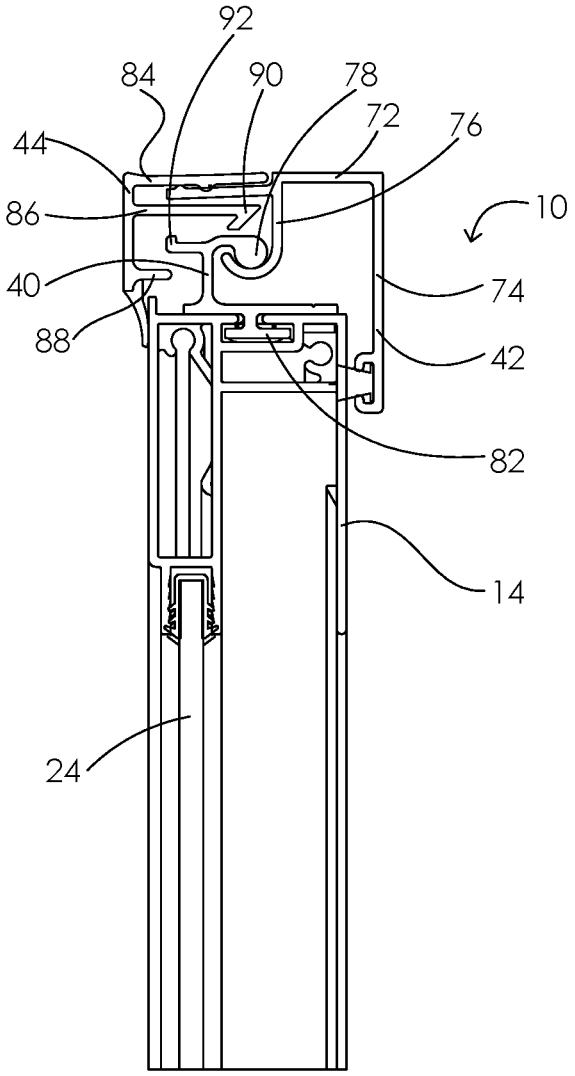
FIG. 4A is a cross sectional view of an embodiment of a secondary or storm window taken along section line A-A of FIG. 3, with the storm or secondary window in a closed position.
Figure 4B:
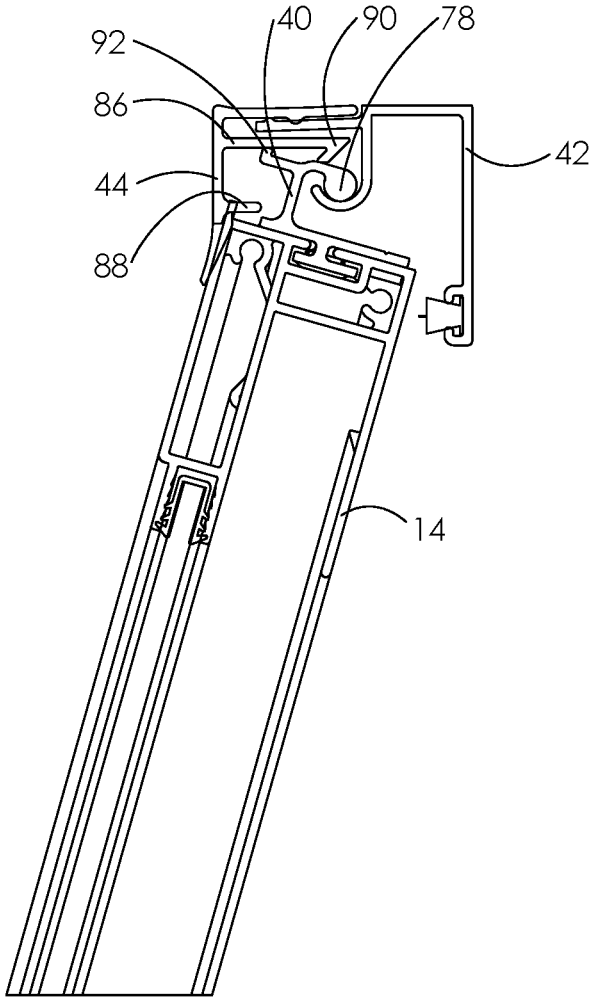
FIG. 4B is a cross sectional view of an embodiment of a secondary or storm window taken along section line A-A of FIG. 3, with the storm or secondary window in a partially-open position.

FIG. 4A is a cross sectional view of an embodiment of the secondary window system 10 taken along section line A-A of FIG. 3 with the secondary window frame 12 in a closed position relative to the top channel member 42. FIG. 4B is a cross sectional view taken along the same section line A-A, but with the secondary window frame 12 in an open or partially-open position relative to the top channel member 42 in order to illustrate the designed interference between components that prevents the secondary window frame 12 from rotating further than desired.

FIG. 4A represents the sectional view taken through the header 14, which includes a number of components for attaching the entire secondary window frame 12 to a primary window frame of a house or other building, as was described briefly above. That is, top channel member 42 is the component that will be attached to a primary window frame to accept the attachment of an embodiment of a secondary window frame. The top channel member 42 is shown as engaged with hanger 40 and top channel retainer 44.

In more particularity, top channel member 42 includes a support member 72 that extends in a generally horizontal direction from a side member 74. A hook member 76 that is generally J-shaped extends downwardly from the support member 72. This hook member 76 is engageable with a curved end portion 78 of the hanger 40. The hanger 40 includes a bottom engagement portion 82 that is positioned within a channel of the header 14.

The top channel retainer 44 may be an extrusion, for example, and includes a first or top extending member 84, a second or middle extending member 86, and a third or bottom extending member 88. First or top extending member 84 is shown with a slight concave profile and is sufficiently long that it will slide over and contact the top of support member 72 of top channel member 42. Second or middle extending member 86 includes an angled portion 90 at its distal end, wherein the angle, position, and length of the angled portion 90 is chosen so that it will engage with a top surface of the hanger 40 when the secondary window frame 12 is in an open or partially open position (see FIG. 4B). Third or bottom extending member 88 has a length such that it does not contact other structures when the secondary window frame 12 is in its closed position (FIG. 4A), but long enough that it contacts a portion of header 14 when the secondary window frame 12 is in its open or partially open position (see FIG. 4B). It is further noted that a tail portion 92 of hanger 40 will contact the bottom of the second extending member 86 when the secondary window frame 12 is in its open position.

Figure 5:
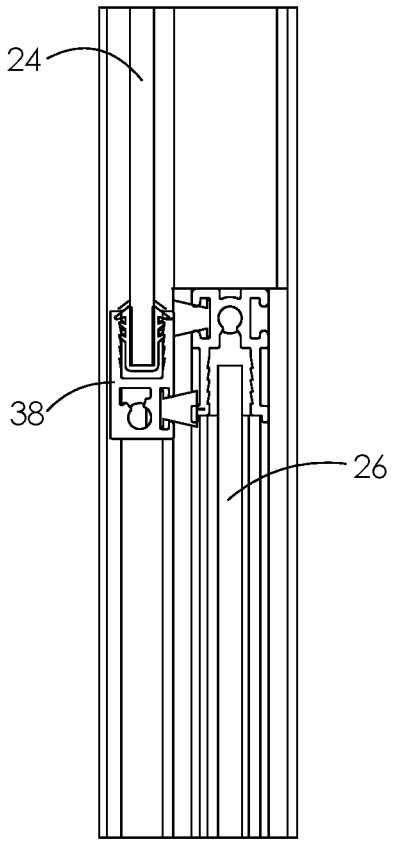
FIG. 5 is a cross sectional view of an embodiment of a secondary or storm window taken along section line B-B of FIG. 3.

FIG. 5 is a cross sectional view of the center area of secondary window frame 12, taken along section line B-B of FIG. 3. An embodiment of mullion 38 is shown as it is located relative to first window panel 24 (which is fixed within the secondary window frame 12, in this embodiment) and second window panel 26 (which is slideable within the secondary window frame 12, in this embodiment).

Figure 6:
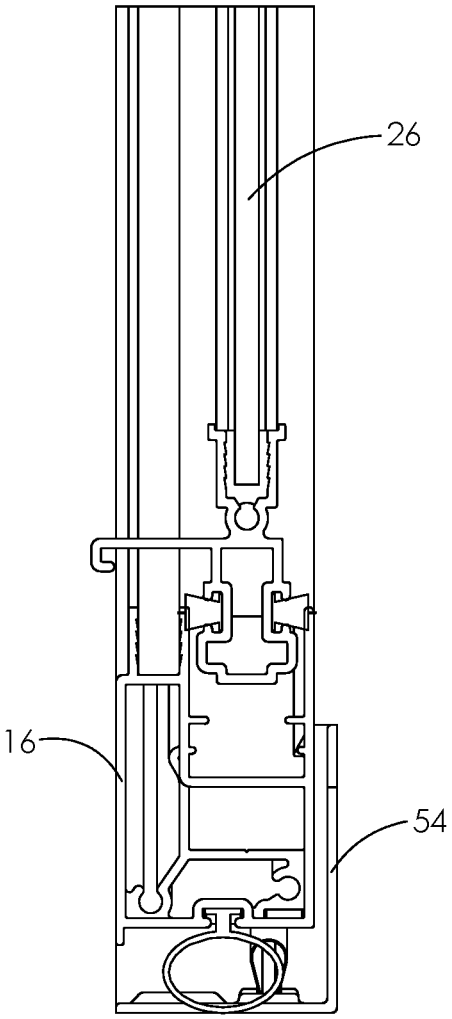
FIG. 6 is a cross sectional view of an embodiment of a secondary or storm window taken along section line C-C of FIG. 3.

FIG. 6 is a cross sectional view of the bottom area of secondary window frame 12, taken along section line C-C of FIG. 3. An embodiment of sill 16 is shown as it is located relative to second window panel 26. Bottom corner stop 54 is visible in this view, which is located with one of its walls beneath the sill 16.

Figure 7:
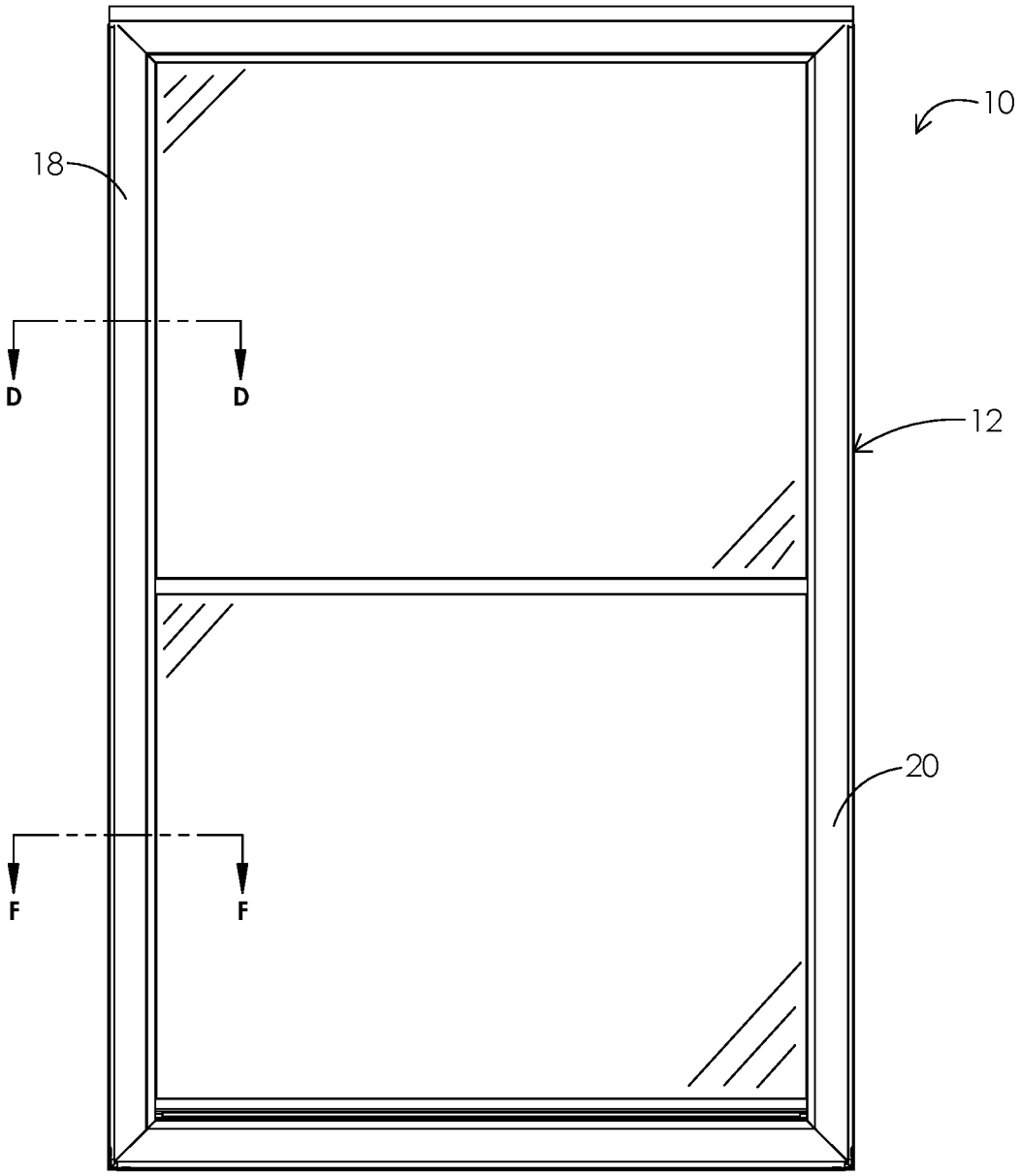
FIG. 7 is another front view of an embodiment of a secondary or storm window and including section lines D-D and F-F.

FIG. 7 is a front view of an embodiment of the secondary window system 10 of FIGS. 1 and 2. This figure includes section lines D-D and F-F to represent the cross-sectional views described below for FIGS. 8 and 9, respectively.

Figure 8:
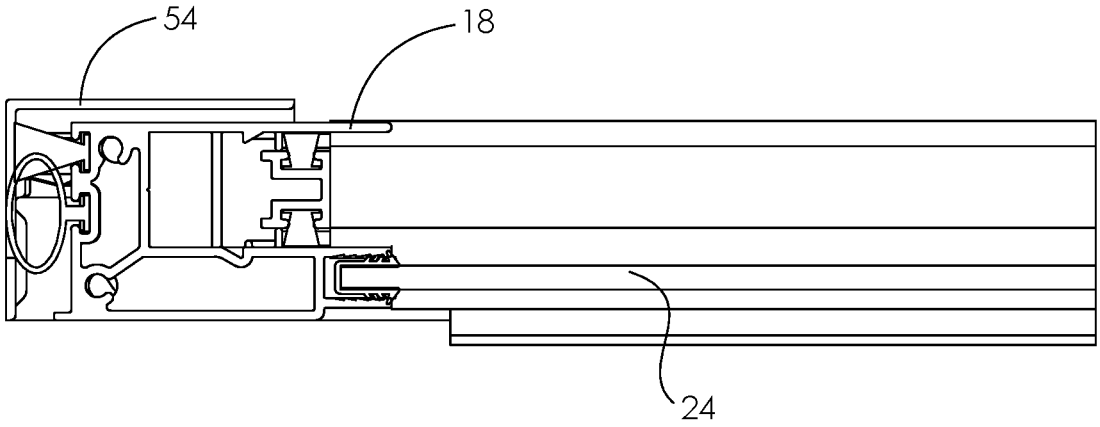
FIG. 8 is a cross sectional view of an embodiment of a secondary or storm window taken along section line D-D of FIG. 7.
Figure 9:
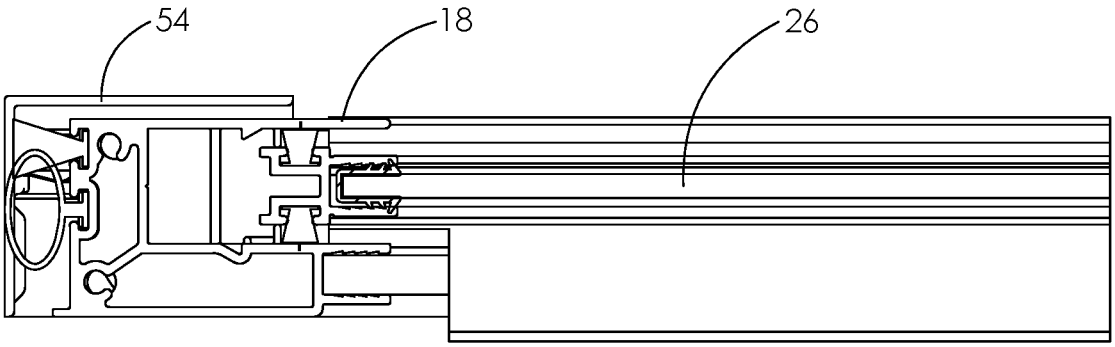
FIG. 9 is a cross sectional view of an embodiment of a secondary or storm window taken along section line F-F of FIG. 7.

FIG. 8 is a cross sectional view of an embodiment of an upper portion of first side jamb 18, taken along section line D-D of FIG. 7. An embodiment of first side jamb 18 is shown as it is located relative to the first window panel 24. A top view of bottom corner stop 54 is visible in this view, which is located with one of its walls behind at least a portion of the first side jamb 18. Similarly, FIG. 9 is a cross sectional view of an embodiment of a lower portion of first side jamb 18, taken along section line F-F of FIG. 7. An embodiment of first side jamb 18 is shown as it is located relative to the second window panel 26. A top view of bottom corner stop 54 is visible in this view, which is located with one of its walls behind at least a portion of the first side jamb 18.

Figure 10:
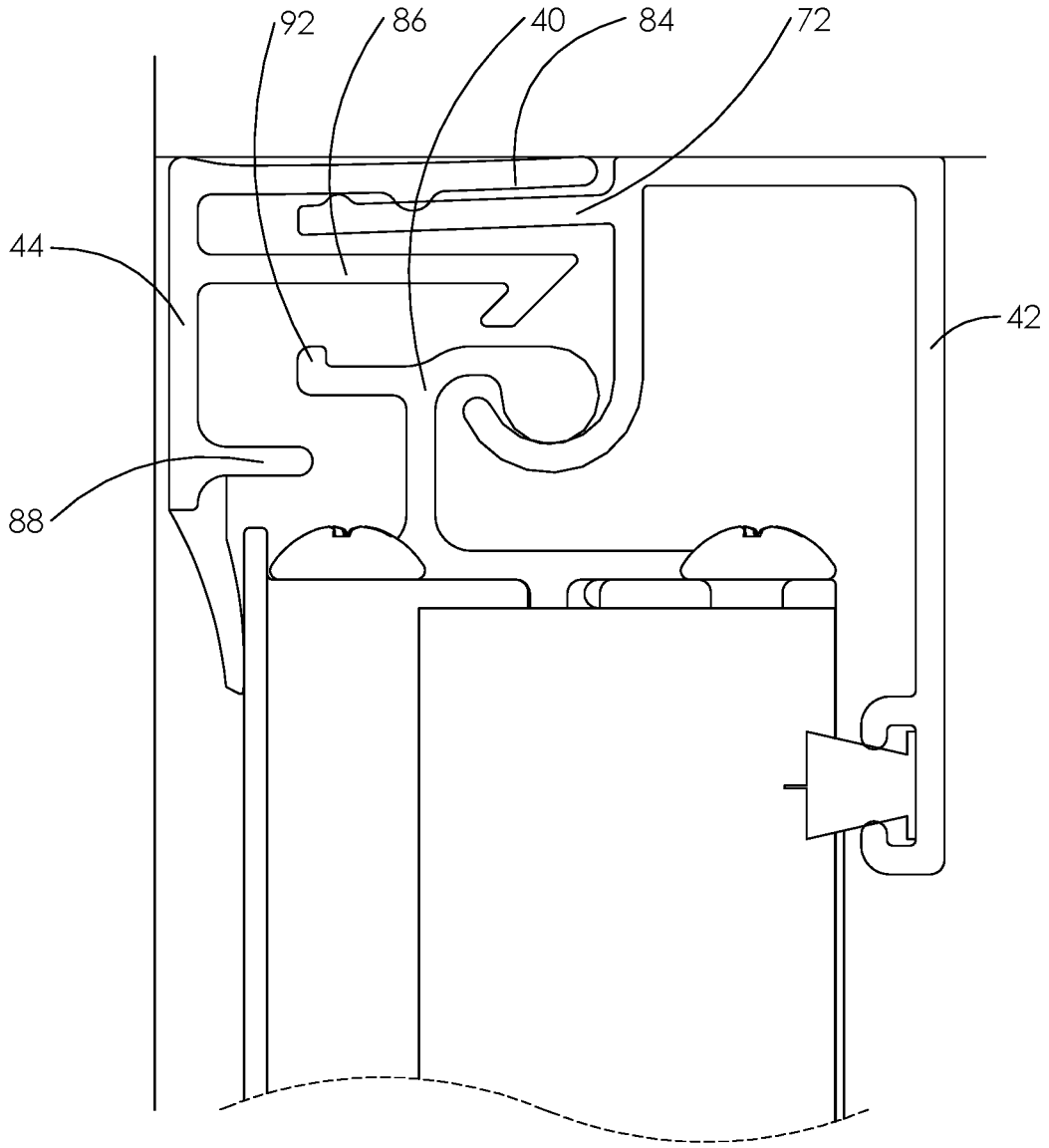
FIG. 10 is an enlarged cross sectional view of a portion of a secondary or storm window of the type illustrated in FIG. 4A, for example, and showing a top channel member, a hanger, and a top channel retainer.

FIG. 10 is an enlarged cross sectional view of a portion of a secondary window system 10 of the type illustrated in FIG. 4A, for example, and showing top channel member 42 engaged with hanger 40 and top channel retainer 44. When these components are assembled, top channel retainer 44 will be positioned so that its first extension member 84 can be slid over the top of support member 72 of top channel member 42, with second extension member 86 positioned below support member 72. The top channel retainer can then be pushed toward the top channel member 42 until it is securely placed (an audible "click" sound may optionally provide an indication that the components are properly secured), wherein the top channel member 42 has already been attached to a window frame of a building structure. In an embodiment, silicone or another sealing material can be used adjacent to the ends of the top channel member 42 to provide additional sealing to minimize or prevent air leakage.

Figure 13:
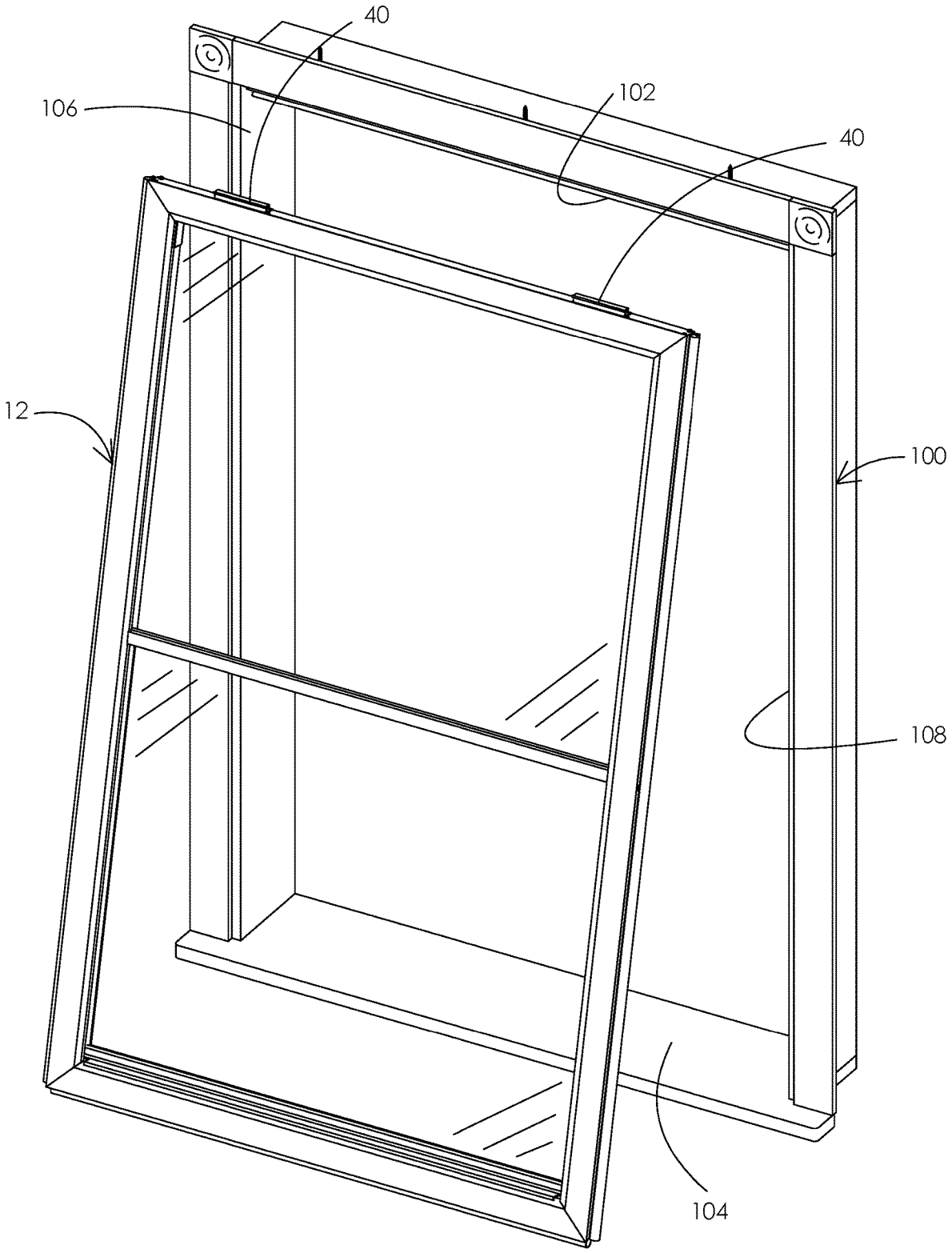
FIG. 13 is perspective view of an embodiment of a vertically-operating secondary or storm window in a position in which it is ready to be installed on a top channel attached to a window frame.

FIG. 13 is perspective view of an embodiment of a vertically-operating secondary window frame 12 in a position in which it is ready to be attached to a primary window frame 100 via its hangers 40. In this and the following embodiments, primary window frame 100 is illustrated as a typical window configuration that includes a top horizontal member 102, a bottom horizontal member 104 spaced from the top horizontal member 102, and first and second side members 106, 108, respectively, spaced from each other and extending between the top and bottom horizontal members 102, 104.

Figure 14:
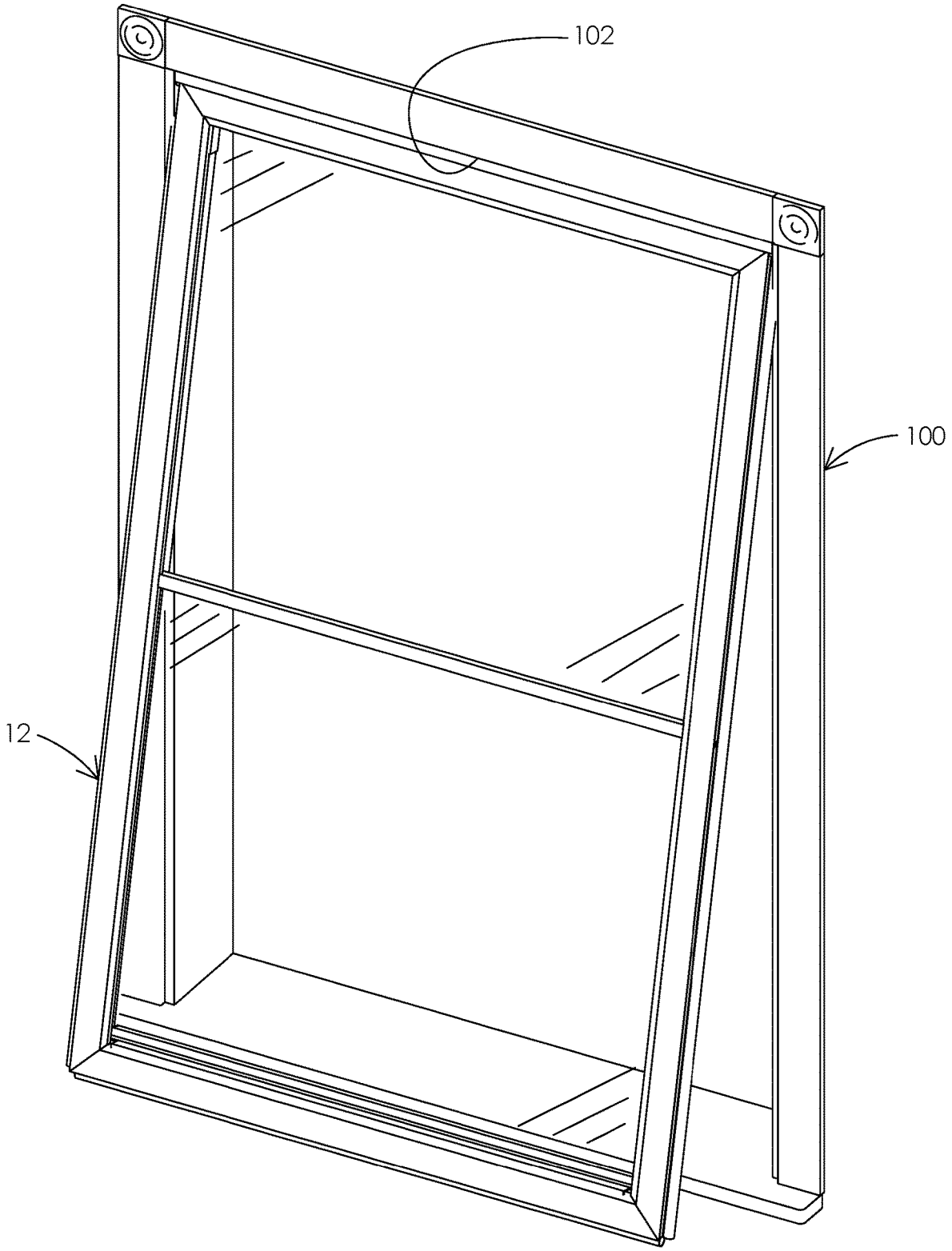

FIG. 14 is a perspective view of secondary window frame 12 of FIG. 13 in a position in which its hangers have been attached to the top channel member that is attached to the top horizontal member 102 of the primary window frame 100 and the bottom of the secondary window frame 12 is rotated partially outward to provide access for locking/unlocking, adjusting the sashes of the prime window, cleaning, or the like.

Figure 15:
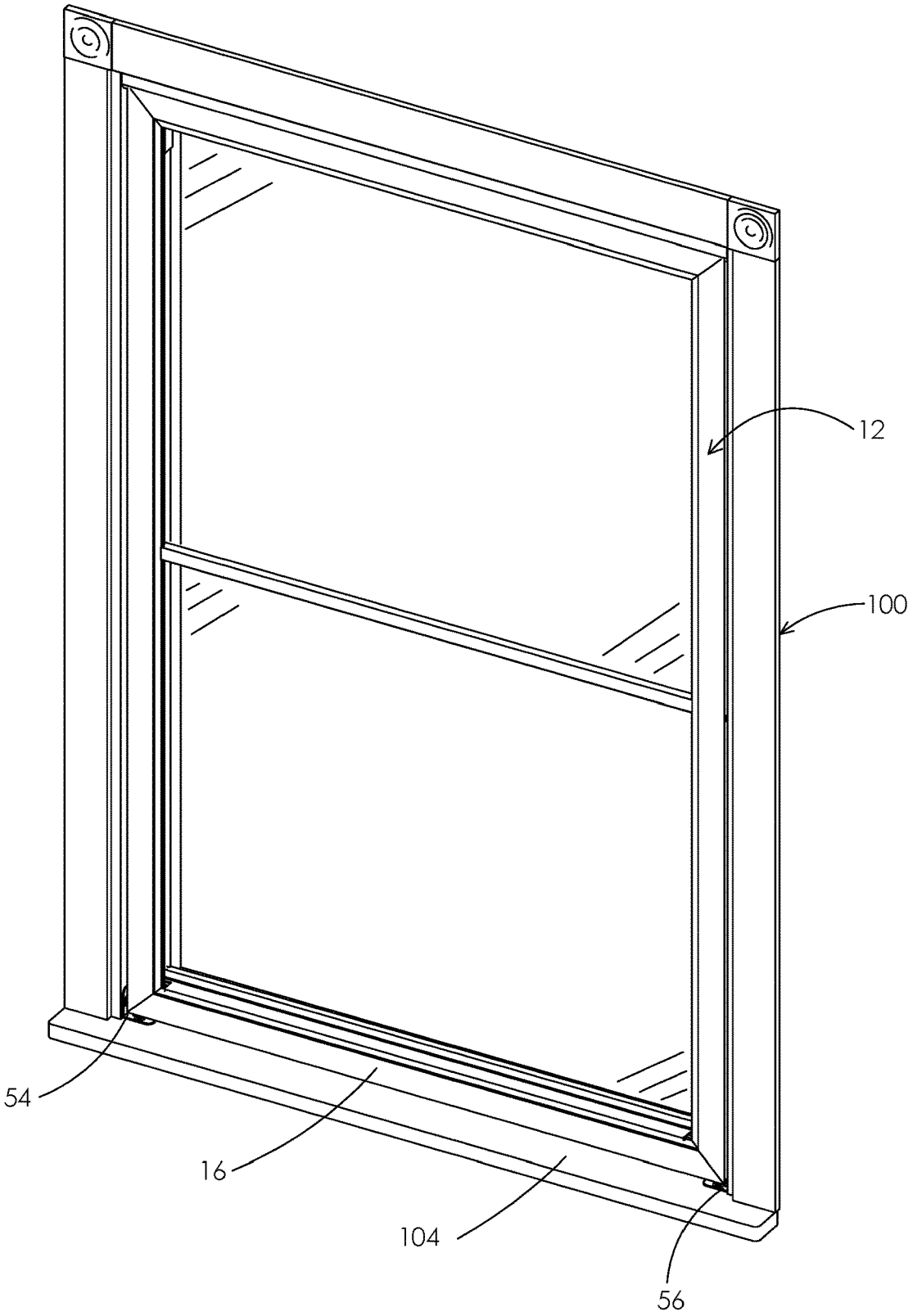
FIG. 15 is a perspective view of the secondary or storm window of FIG. 13 in a closed position relative to the window frame.
Figure 18:
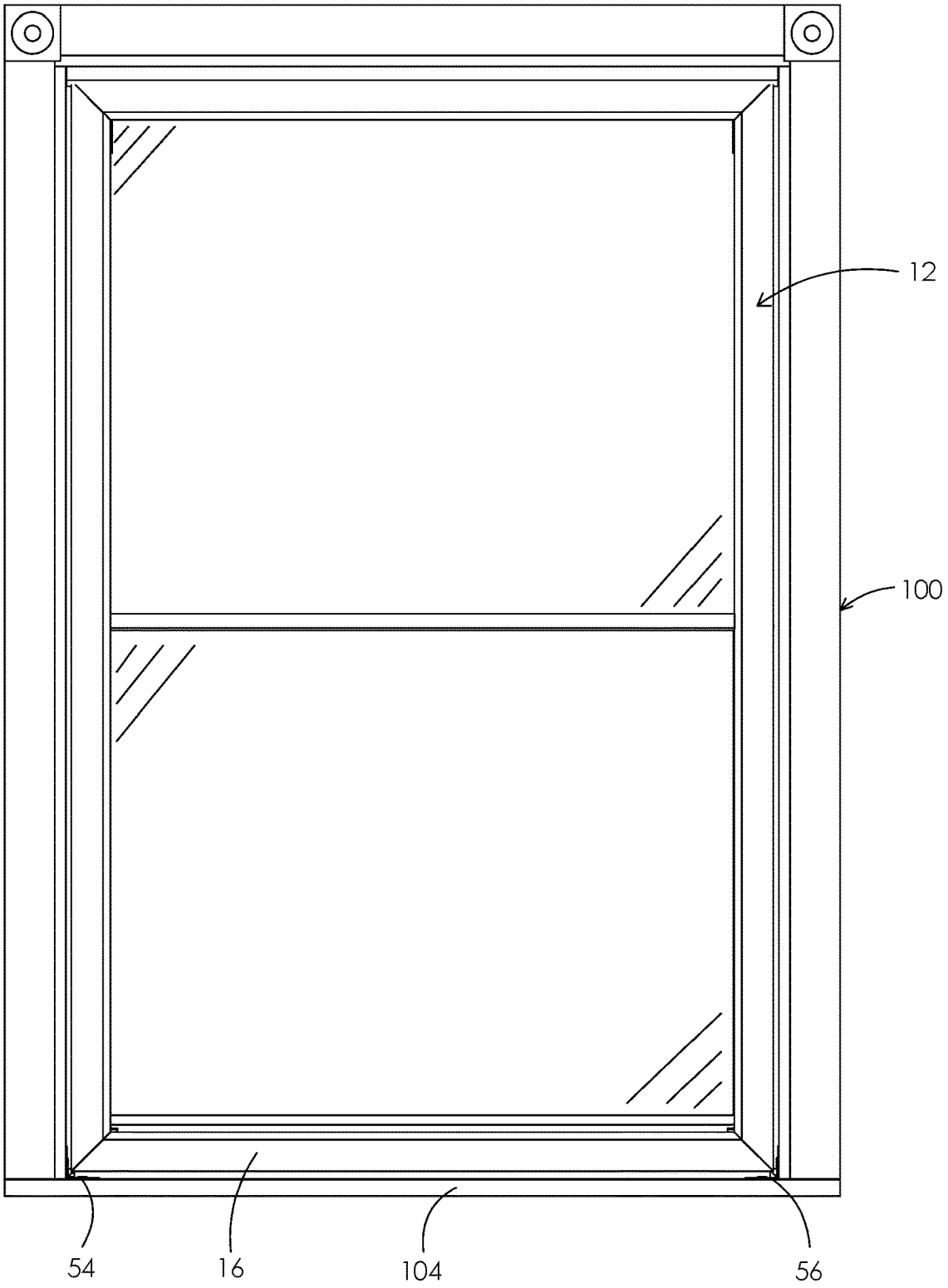
FIG. 18 is a front view of the secondary or storm window of FIG. 15 in a closed position relative to the window frame.

FIGS. 15 and 18 illustrate the secondary window frame 12 in a position in which its sill 16 is pressed into place relative to bottom corner stops 54, 56 that are mounted on bottom horizontal member 104 of the primary window frame 100. This configuration can be considered to be the "closed" configuration of the secondary window system 10.

Figure 16:
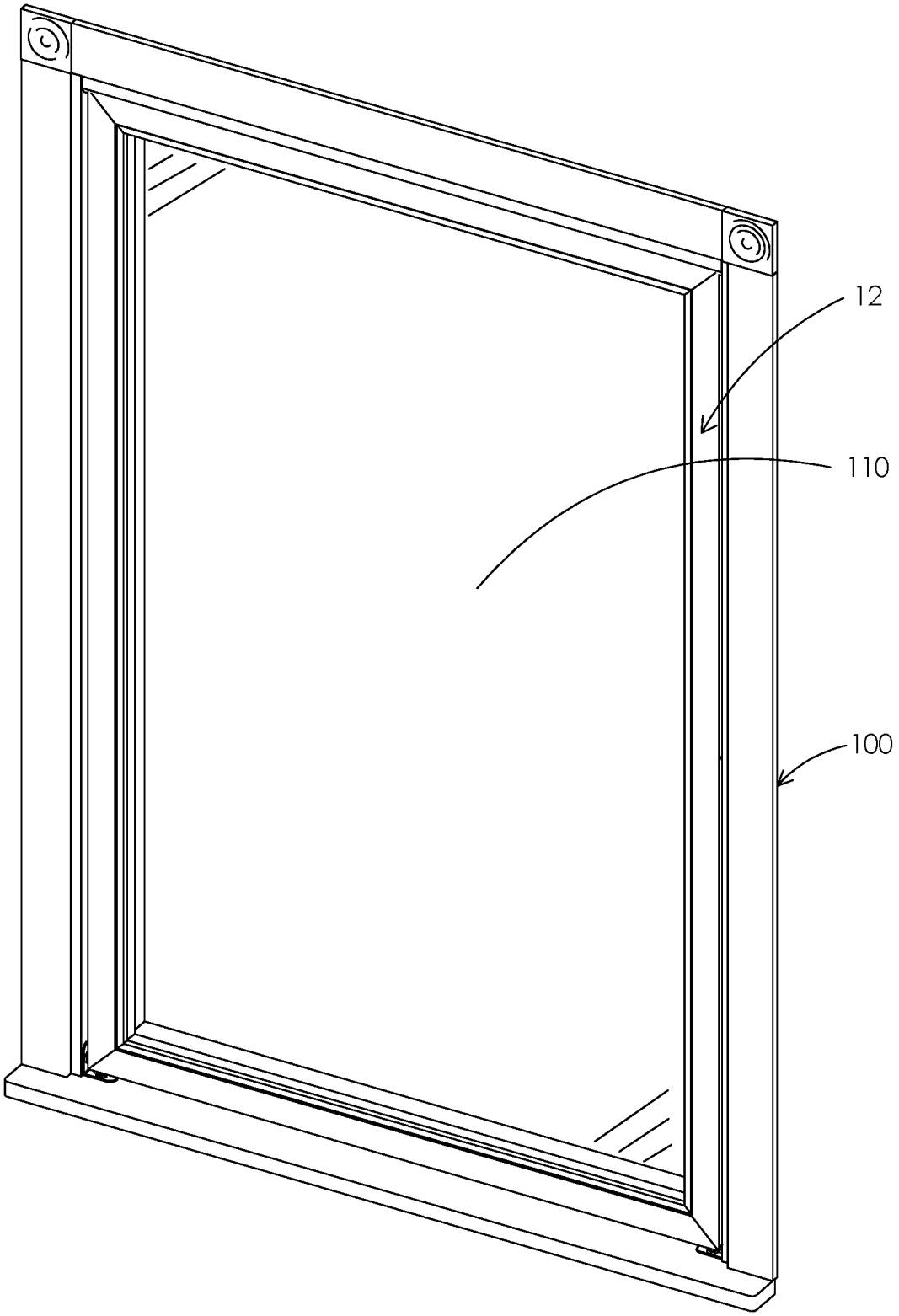
FIG. 16 is a perspective view of an embodiment of a fixed secondary or storm window mounted within a window frame.

FIG. 16 is a perspective view of an embodiment of a secondary window frame 12 in a closed position within a primary window frame 100. With this embodiment, a single stationary window panel 110 is provided within the opening of the secondary window frame 12, rather than the double-panel configurations discussed above.

Figure 17:
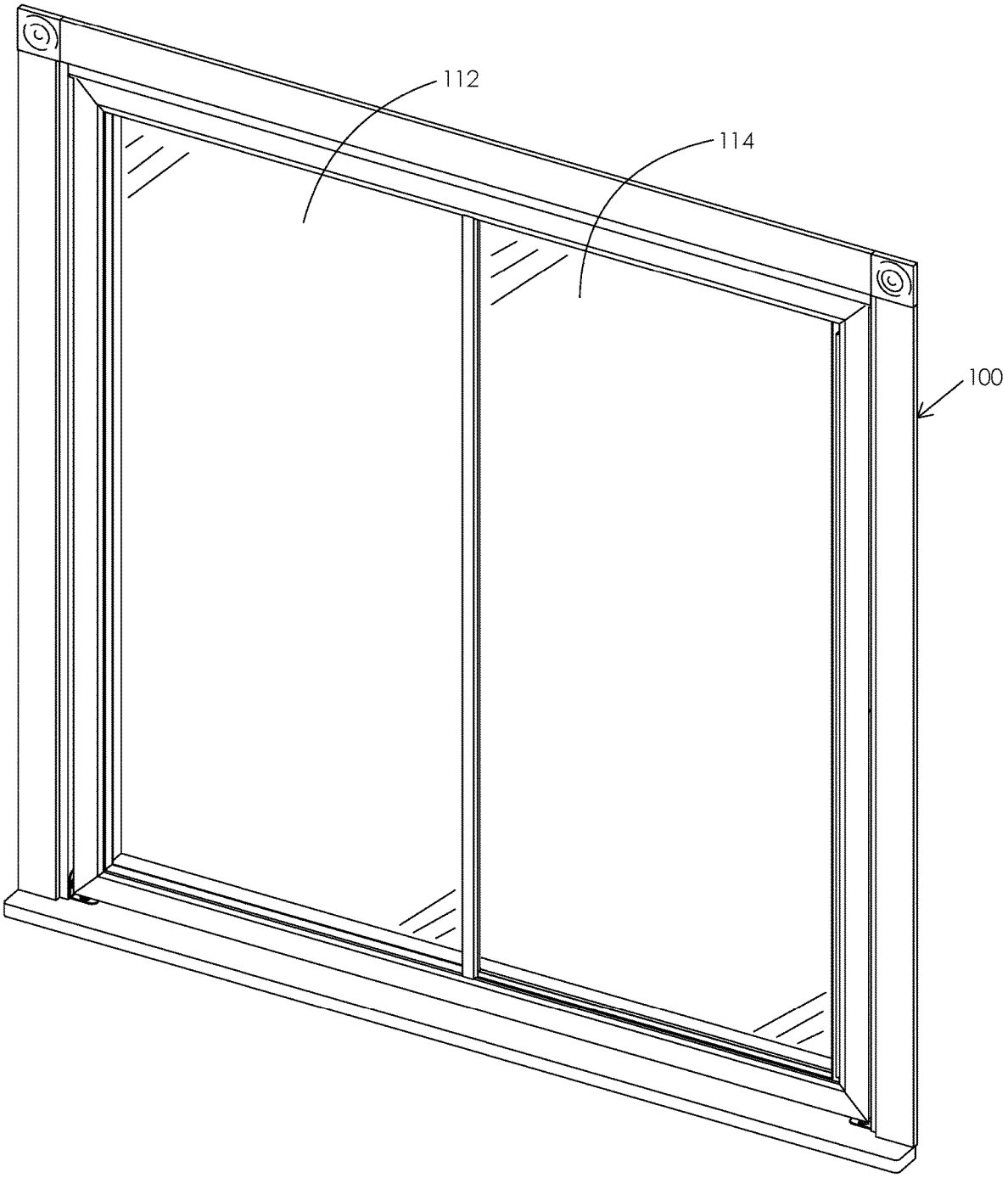
FIG. 17 is a perspective view of a horizontally-operating secondary or storm window mounted within a window frame.

FIG. 17 is a perspective view of a horizontally-operating secondary window system mounted within a primary window frame 100. This system includes a first window panel 112, which may be fixed within the window frame, and a second window panel 114, which may be moveable relative to the first window panel 112. Conversely, second window panel 114 may be fixed within the window frame and first window panel 112 may be moveable relative to the second window panel 114, or both window panels 112 and 114 may be moveable relative to each other. The features and variations thereof discussed above relative to a vertically-operating secondary window system are equally applicable to the horizontally-operating secondary window system illustrated in this figure.

Figure 19:
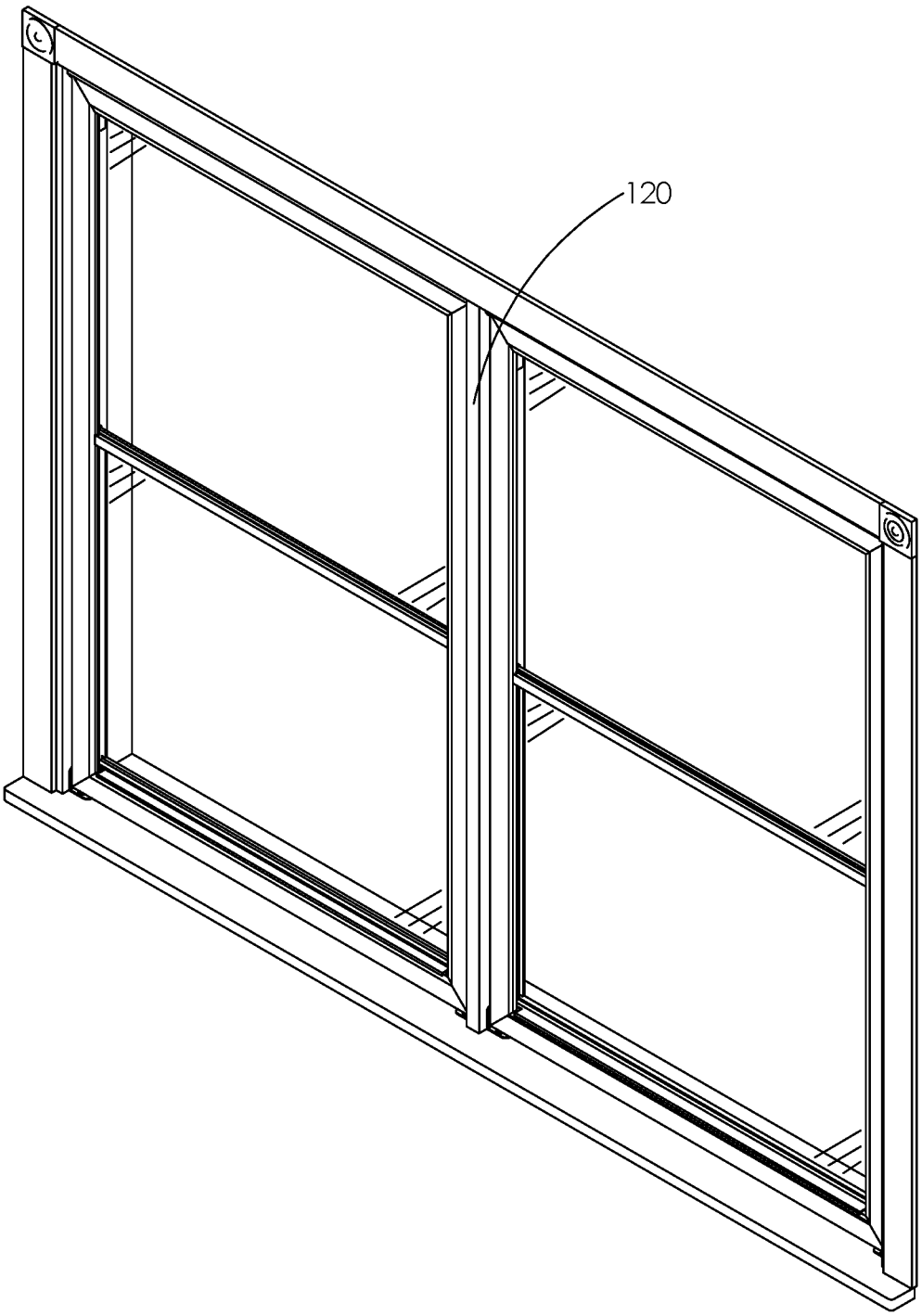
FIG. 19 is a perspective view of a secondary or storm window system of the invention, including two storm windows.
Figure 20:
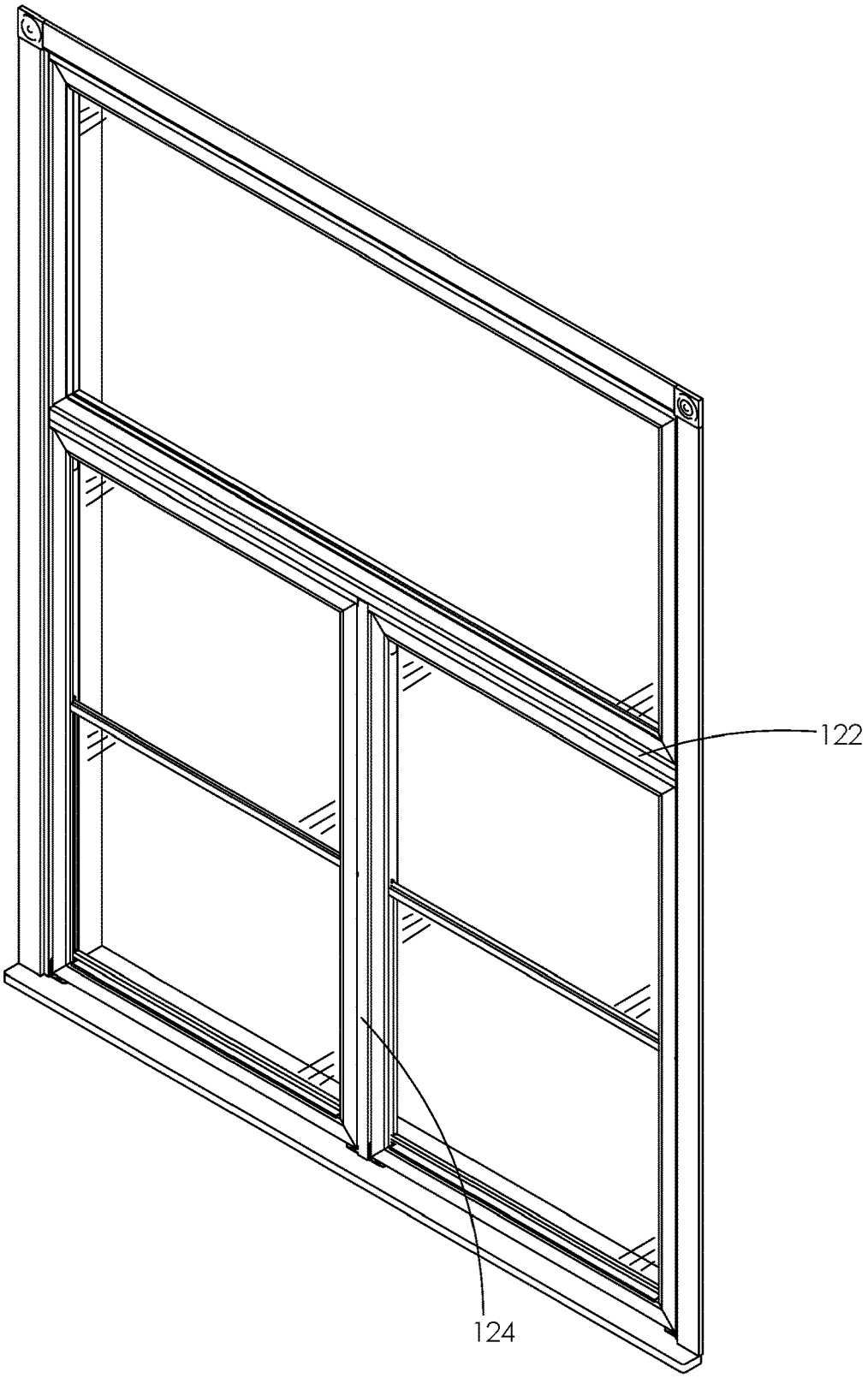
FIG. 20 is a perspective view of a secondary or storm window system of the invention, including multiple storm windows.

In other window frame configurations, two or more primary windows are positioned within a primary window frame. For example, to maintain consistent aesthetics and sight lines between the primary and storm or secondary windows, it may be desirable to divide the primary window opening into multiple smaller openings, wherein each opening is capable of receiving a single storm or secondary window. FIG. 19 illustrates one exemplary configuration in which two storm or secondary windows are mounted in a primary window frame, while FIG. 20 illustrates another exemplary configuration in which three storm or secondary windows are mounted in a primary window frame. In these exemplary configurations, a vertical mullion bar 120 (FIG. 19) or a horizontal mullion bar 122 and a vertical mullion bar 124 (FIG. 20) may be used to divide the primary window frame into multiple smaller openings. Secondary window systems as described herein can be utilized within some or all of these smaller openings.

The present invention has now been described with reference to several embodiments thereof. The foregoing detailed description and examples have been given for clarity of understanding only. No unnecessary limitations are to be understood therefrom. It will be apparent to those skilled in the art that many changes can be made in the embodiments described without departing from the scope of the invention. The implementations described above and other implementations are within the scope of the following claims.

What is claimed is:

1. A secondary window system installable within a primary window frame that comprises a top horizontal member, a bottom horizontal member spaced from the top horizontal member, and first and second side members spaced from each other and extending between the top and bottom horizontal members, the secondary window system comprising:

a top channel member attachable to and extending along at least a portion of the top horizontal member of the primary window frame, the top channel member comprising a hanger engagement portion;

a secondary window frame comprising a header, a sill spaced from the header, first and second side jambs spaced from each other and extending from the header to the sill, and a secondary window frame opening defined by the secondary window frame;

at least one hanger engageable with the hanger engagement portion of the top channel member, wherein the secondary window frame is rotatable relative to the primary window frame about the at least one hanger; and a top channel retainer removeably engageable with the top channel member, the top channel retainer comprising a hanger-engagement extension member extending toward the hanger engagement portion of the top channel member.

2. The secondary window system of claim 1, further comprising:

a first window panel mounted within the secondary window frame opening; and a second window panel mounted within the secondary window frame opening and moveable relative to the first window panel.

3. The secondary window system of claim 2, wherein the first window panel is one of fixed or moveable within the secondary window frame opening.

4. The secondary window system of claim 2, wherein at least one of the first and second window panels comprises a glass panel.

5. The secondary window system of claim 1, wherein the top channel retainer is engageable with the header of the secondary window frame, and wherein the at least one hanger is engageable with the hanger-engagement extension member of the top channel retainer.

6. The secondary window system of claim 1, further comprising a single window panel mounted within the secondary window frame opening.

7. The secondary window system of claim 1, further comprising at least one bottom stop member attachable to the bottom horizontal member of the primary window frame.

8. The secondary window system of claim 7, wherein the at least one bottom stop member comprises:

a first bottom stop member that is further attachable to the first side member of the primary window frame; and a second bottom stop member that is further attachable to the second side member of the primary window frame.

9. The secondary window system of claim 7, wherein the at least one bottom stop member comprises a universal bottom stop member that is further attachable to either of the first and second side members of the primary window frame.

10. The secondary window system of claim 7, wherein the sill of the secondary window frame is engageable with the at least one bottom stop member when the secondary window system is in a closed position.

11. The secondary window system of claim 7, wherein the sill of the secondary window frame is spaced from the at least one bottom stop member when the secondary window system is in an at least partially open position.

12. The secondary window system of claim 1, further comprising first and second primary weatherstrips positionable between the first and second side jambs of the secondary window frame and the first and second side members of the primary window frame, respectively.

13. The secondary window system of claim 12, further comprising first and second intermediate weatherstrips positionable between the first and second side jambs of the secondary window frame and the first and second side members of the primary window frame, respectively.

14. The secondary window system of claim 1, further comprising a sill weatherstrip positionable between the sill of the secondary window frame and the bottom horizontal member of the primary window frame.

15. The secondary window system of claim 1, wherein the hanger engagement portion of the top channel member comprises a hook member engageable with an extending member of the at least one hanger.

16. The secondary window system of claim 15, wherein the top channel member further comprises a top channel support member, wherein the hook member extends from the top channel support member toward the extending member of the at least one hanger.

17. The secondary window system of claim 16, wherein the top channel retainer further comprises a first top channel retainer extension member engageable with the top channel support member of the top channel member.

18. The secondary window system of claim 1, wherein the hanger-engagement extension member of the top channel retainer comprises at least one retaining feature for limiting rotation of the secondary window frame relative to the primary window frame, wherein the hanger-engagement extension member is engageable with the at least one hanger for limiting rotation of the secondary window frame relative to the primary window frame.

19. The secondary window system of claim 18, wherein the top channel retainer further comprises a header-engagement extension member engageable with a portion of the header.

20. A secondary window system installable within a primary window frame opening that comprises a top horizontal member, a bottom horizontal member spaced from the top horizontal member, and first and second side members spaced from each other and extending between the top and bottom horizontal members, the secondary window system comprising:

a top channel member attachable to and extending along at least a portion of the top horizontal member of the primary window frame;

a top channel retainer engageable with the top channel member;

a secondary window comprising:

a frame comprising a header, a sill, a right jamb, and a left jamb, wherein the header comprises at least one hanger, wherein the right and left jamb comprise channels and at least one perimeter weatherstrip;

a first window panel; and a second window panel; and first and second bottom corner stops attachable to the bottom horizontal member of the primary window frame.

21. The secondary window system of claim 20, wherein the second window panel is repositionable relative to the first window panel.

22. The secondary window system of claim 21, wherein the first window panel is fixed.

23. The secondary window system of claim 21, further comprising a single window panel mounted within the secondary window frame.

24. The secondary window system of claim 21, wherein at least one of the first and second bottom corner stops comprise a weatherstrip channel, and wherein the secondary window system further comprises first and second corner stop weatherstrips positioned within the weatherstrip channels of the first and second bottom corner stops, respectively.

25. The secondary window system of claim 24, wherein the first and second bottom corner stops are identical and repositionable for attachment in opposite corners of the primary window frame.

26. An installation process for mounting a secondary window system within a primary window opening, comprising the steps of:

attaching a top channel member to a top header of a primary window frame that partially defines the primary window opening;

attaching first and second bottom corner stops to a sill of the primary window frame that partially defines the primary window opening;

attaching a secondary window system to the top channel member that is attached to the primary window frame, the secondary window system comprising a header comprising at least one hanger, a sill, and first and second jambs spaced from each other and extending between the header and the sill by connecting the at least one hanger to the top channel member;

rotating the sill of the secondary window system toward the first and second bottom corner stops;

sealing the secondary window system to the primary window frame by contacting the first and second bottom corner stops with the corners of the sill; and connecting a top channel retainer to the top channel member.

* * * * *